US010068400B2

(12) United States Patent
Gerlach

(10) Patent No.: US 10,068,400 B2
(45) Date of Patent: Sep. 4, 2018

(54) APPARATUS, METHOD AND COMPUTER PROGRAM FOR CONTROLLING FUNCTIONS OF A VEHICLE

(71) Applicant: VOLKSWAGEN AG, Wolfsburg (DE)

(72) Inventor: Simon Gerlach, Meine (DE)

(73) Assignee: Volkswagen AG (DE)

( * ) Notice: Subject to any disclaimer, the term of this patent is extended or adjusted under 35 U.S.C. 154(b) by 0 days.

(21) Appl. No.: 15/388,747

(22) Filed: Dec. 22, 2016

(65) Prior Publication Data

US 2017/0186257 A1 Jun. 29, 2017

(30) Foreign Application Priority Data

Dec. 23, 2015 (DE) ..... 10 2015 226 651

(51) Int. Cl.
*G07C 9/00* (2006.01)

(52) U.S. Cl.
CPC ..... *G07C 9/00309* (2013.01); *G07C 2009/00769* (2013.01)

(58) Field of Classification Search
CPC ..... G07C 9/00309; B60W 50/0098
See application file for complete search history.

(56) References Cited

U.S. PATENT DOCUMENTS 5,964,813 A 10/1999 Ishii et al.
2004/0010358 A1 1/2004 Oesterling et al.
2005/0288837 A1 12/2005 Wiegand et al.
2007/0038345 A1 2/2007 Heider et al.
2012/0226413 A1* 9/2012 Chen ..... B60R 16/037 701/36
2013/0204455 A1 8/2013 Chia et al.
2013/0297099 A1 11/2013 Rovik
2017/0080949 A1* 3/2017 Sinaguinan ..... B60W 50/0098

FOREIGN PATENT DOCUMENTS

DE 3900494 A1 7/1990
DE 10039756 A1 2/2002

OTHER PUBLICATIONS

Search Report for German Patent Application No. 10 2015 226 651.6; dated Sep. 22, 2016.

* cited by examiner

*Primary Examiner* — Curtis Odom
(74) *Attorney, Agent, or Firm* — Barnes & Thornburg LLP

(57) ABSTRACT

Apparatuses, methods and computer programs for controlling functions of a vehicle. The apparatus for an information system of a vehicle includes a communication module for communication with a mobile device and a control module for controlling the communication module. The control module obtains a key signal and information about a user profile from the mobile device via the communication module. The user profile includes user settings for functions of the vehicle. The information about the user profile includes data about at least one subset of the user settings. The control module controls a locked state of the vehicle based on the key signal and controls at least one subset of the functions of the vehicle based on the information about the user profile.

16 Claims, 3 Drawing Sheets

APPARATUS, METHOD AND COMPUTER PROGRAM FOR CONTROLLING FUNCTIONS OF A VEHICLE

PRIORITY CLAIM

This patent application claims priority to German Patent Application No. 10 2015 226 651.6, filed 23 Dec. 2015, the disclosure of which is incorporated herein by reference in its entirety.

SUMMARY

Illustrative embodiments relate to apparatuses, methods and a computer program for controlling functions of a vehicle, more specifically, but not exclusively, on the basis of a transmission of information about a user profile from a mobile device to an information system of the vehicle.

BRIEF DESCRIPTION OF THE DRAWINGS

Disclosed embodiments are described in more detail below and are represented in the drawings to which there is generally no overall restriction. In the drawings.

DETAILED DESCRIPTION

Figure 1:
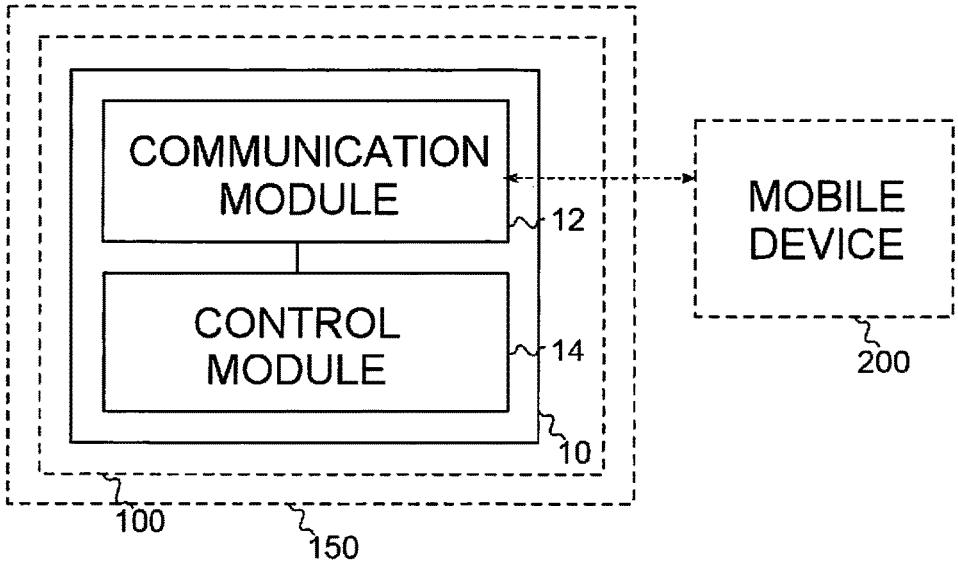
FIG. 1 illustrates a block diagram of an exemplary embodiment of an apparatus for an information system of a vehicle.

Connection of mobile devices to vehicles is an important trend in vehicle design. The mobile device can, for example, under the protection of digital certificates, be used to unlock vehicles. At the same time, functions of the mobile device, for example, the representation of navigation information or the playback of music or other media, can be transmitted to a screen or a loudspeaker system of the vehicle.

Further, it may be desirable for settings that are used in a vehicle, for example, radio stations, seat position, navigation destinations or the like, to be transmitted between vehicles. In this case, in conventional systems, it is possible, by way of example, for settings to be transferred via a read only memory, for example, a flash memory, or files can be stored in a user profile on the Internet and retrieved from the vehicle via an Internet connection. This can be hampered by an Internet connection of a vehicle possibly not being available, for example, as a result of parking in an underground garage or as a result of use in an area in which there is no Internet connection available, or by virtue of the user of the vehicle having to transfer the read only memory manually.

There is a need for an improved design for the transmission of user settings for a vehicle. This need is met by apparatuses and methods according to the independent claims.

Exemplary embodiments can achieve this by virtue of information about a user profile being transmitted between a mobile device, for example, a smartphone (programmable cell phone) and an information system of the vehicle. In exemplary embodiments, it is possible to use the fact that the mobile device is used to transmit a key signal for unlocking the vehicle. In the course of this transmission, a user profile can be transmitted at least in part from the mobile device to the information system, comprising user settings for controlling functions of the vehicle. If the information system of the vehicle already comprises an earlier version of the user profile, then the information system may be designed to reciprocally augment the received user profile and the earlier version of the user profile, for example, to reduce a data transmission.

Exemplary embodiments provide an apparatus for an information system of a vehicle. The apparatus comprises a communication module, designed for communication with a mobile device. The apparatus further comprises a control module, designed for controlling the communication module. The control module is further designed for obtaining a key signal and information about a user profile from the mobile device via the communication module. The user profile comprises a plurality of user settings for a plurality of functions of the vehicle. The information about the user profile comprises data about at least one subset of the plurality of user settings. The control module is further designed for controlling a locked state of the vehicle on the basis of the key signal, and for controlling at least one subset of the plurality of functions of the vehicle on the basis of the information about the user profile. Obtaining the information about the user profile from the mobile device can allow the user settings to be transmitted without an Internet connection of the vehicle. By way of example, it is thus possible to update or expand a user profile that is already present on the vehicle. The transmission of the information about the user profile and the key signal from the mobile device can use a connection of the mobile device to the information system of the vehicle for unlocking to transmit the information about the user profile and to reduce an additional communication complexity.

In some exemplary embodiments, the key signal can comprise the information about the user profile. The transmission of the information about the user profile comprised in the key signal from the mobile device can use a connection of the mobile device to the information system of the vehicle for unlocking to transmit the information about the user profile and to reduce an additional communication complexity.

In at least some exemplary embodiments, the control module may be designed to store the user profile in a first version. The information about the user profile can comprise information about a second version of the user profile. The second version of the user profile may be at least in part more up to date than the first version of the user profile. The control module may be designed to update the stored version of the user profile on the basis of the information about the user profile. The updating can reduce a data transmission, since, by way of example, it would be possible for only portions of the user profile that are not up to date in the stored version to be transmitted.

In some exemplary embodiments, the stored version of the user profile can comprise information about a first version counter. The information about the user profile can comprise information about a second version counter. The control module may be designed to update the stored version on the basis of the information about the first version counter and on the basis of the information about the second version counter. The use of a version counter allows ascertainment of whether the stored version is up to date and selective updating.

In at least some exemplary embodiments, the information about the first version counter can comprise information about version counters for the plurality of functions. The information about the second version counter can comprise information about version counters for the subset of the plurality of functions. The control module may be designed to update the stored version of the user profile on the basis of the information about the version counters for the plurality of functions and on the basis of information about the version counters for the subset of the plurality of functions. The use of version counters for the plurality of functions, that is to say, by way of example, of separate counters for separate functions, allows finely granular updating and can reduce a data transmission.

The control module may be designed to provide the information about the first version counter for the mobile device. The information about the user profile may be based on the information about the first version counter and on the information about the second version counter. The provision of the information about the first version counter can allow the mobile device to transmit only portions of the user profile that are not up to date, and can reduce a data transmission.

In at least some exemplary embodiments, the stored version of the user profile can comprise a first piece of information about a last change time of the stored version of the user profile. The information about the user profile can comprise a second piece of information about a last change time of the second version of the user profile. The control module may be designed to update the stored version of the user profile on the basis of the first information about the last change time of the stored version of the user profile and on the basis of the second information about the last change time of the second version of the user profile. The use of the information about the last change time (also called a timestamp) allows ascertainment of whether the stored version is up to date.

In at least some exemplary embodiments, the first information about the last change time of the first version can comprise information about change times for the plurality of functions. The second information about the last change time of the second version can comprise information about change times for the subset of the plurality of functions. The control module may be designed to update the stored version of the user profile on the basis of the information about the change times for the plurality of functions and on the basis of the information about the change times for the subset of the plurality of functions. The use of the information about the last change time for the plurality of functions, that is to say of separate counters for separate functions, for example, allows finely granular updating and can reduce a data transmission.

In some exemplary embodiments, the control module may be designed to provide the first information about the last change time of the first version for the mobile device. The information about the user profile may be based on the first information about the last change time of the first version and on the second information about the last change time of the second version. The provision of the first information about the last change time can allow the mobile device to transmit only portions of the user profile that are not up to date, and can reduce a data transmission.

In at least some exemplary embodiments, the information about the user profile can comprise information about an identification of the user. The control module may be designed to obtain the user profile on the basis of the information about the identification of the user from a server. The transmission of the information about the identification of the user can allow the user profile to be updated, for example, via an Internet connection of the vehicle, for example, to reduce a data transmission between mobile device and information system.

In at least some exemplary embodiments, the control module may be designed to store one or more user profiles. The information about the user profile can comprise information about an identification of the user. The control module may be designed to select a user profile from the one or more user profiles on the basis of the information about the identification of the user and to control at least one subset of the plurality of functions of the vehicle on the basis of the selected user profile. The selection of the user profile can allow multiple user profiles to be kept to hand and hence multiuser operation.

In at least some exemplary embodiments, the communication module may be designed to communicate with the mobile device directly. The communication module may be designed, by way of example, to communicate with the mobile device via a short-range radio link. The direct communication can allow the user settings to be transmitted, even when there is no Internet connection available, for example.

Exemplary embodiments further provide an apparatus for a mobile device. The apparatus comprises a communication module, designed for communication with an information system of a vehicle. The apparatus further comprises a control module, designed for controlling the communication module. The control module is further designed for providing a key signal for controlling a locked state of the vehicle and information about a user profile for controlling at least one subset of a plurality of functions of the vehicle for the information system via the communication module. The user profile comprises a plurality of user settings for the plurality of functions of the vehicle. The information about the user profile comprises data about at least one subset of the plurality of user settings. The transmission of the information about the user profile and the key signal from the mobile device can use a connection of the mobile device to the information system of the vehicle for unlocking, to transmit the information about the user profile and to reduce an additional communication complexity.

In at least some exemplary embodiments, the information system can comprise a first version of the user profile. The control module may be designed to determine the information about the user profile on the basis of a second version of the user profile. The second version of the user profile may be at least in part more up to date than the first version of the user profile.

The first version of the user profile can comprise information about a first version counter and the second version of the user profile can comprise information about a second version counter. The control module may further be designed to obtain the information about the first version counter from the information system. The control module may further be designed to provide the information about the user profile on the basis of the information about the first version counter and on the basis of the information about the second version counter. The obtaining of the information about the first version counter can allow the apparatus to transmit only portions of the user profile that are not up to date, and can reduce a data transmission.

Alternatively or additionally, the first version of the user profile can comprise a first piece of information about a last change time of the first version of the user profile. The second version can comprise a second piece of information about a last change time of the second version of the user profile. The control module may be designed to provide the information about the user profile on the basis of the first information about the last change time of the first version and on the basis of the second information about the last change time of the second version. The obtaining of the first information about the last change time can allow the apparatus to transmit only portions of the user profile that are not up to date, and can reduce a data transmission.

Exemplary embodiments further provide a method for an information system of a vehicle. The method comprises obtaining a key signal and information about a user profile from a mobile device. The user profile comprises a plurality of user settings for a plurality of functions of the vehicle. The information about the user profile comprises data about at least one subset of the plurality of user settings. The method further comprises controlling a locked state of the vehicle on the basis of the key signal. The method further comprises controlling at least one subset of the plurality of functions of the vehicle on the basis of the information about the user profile.

Exemplary embodiments further provide a method for a mobile device. The method comprises providing a key signal for controlling a locked state of a vehicle. The method further comprises providing information about a user profile for controlling at least one subset of a plurality of functions of the vehicle for an information system of the vehicle. The user profile comprises a plurality of user settings for the plurality of functions of the vehicle. The information about the user profile comprises data about at least one subset of the plurality of user settings.

Exemplary embodiments further provide a program having a program code for performing at least one of the methods when the program code is executed on a computer, a processor, a control module or a programmable hardware component.

Exemplary embodiments further provide the information system comprising the apparatus for the information system. Exemplary embodiments further provide the vehicle comprising the information system and the apparatus for the information system. Exemplary embodiments further provide the mobile device comprising the apparatus for the mobile device.

Various exemplary embodiments are now described in more detail with reference to the accompanying drawings, in which some exemplary embodiments are represented. In the figures, the thickness dimensions of lines, layers and/or regions may be depicted in and exaggerated state for the sake of clarity.

In the description of the appended figures below, which show only some exemplary embodiments by way of example, like reference symbols can denote like or comparable components. Further, combinative reference symbols can be used for components and objects that arise repeatedly in an exemplary embodiment or in a drawing, but are described together for one or more features. Components or objects that are described using like or combinative reference symbols may have single, multiple or all features, for example, their dimensionings, embodied in like state, but possibly also in different state, unless the description explicitly or implicitly reveals otherwise.

Although exemplary embodiments can be modified and varied in different ways, exemplary embodiments are presented as examples in the figures and are described in detail herein. However, it should be clarified that the intention is not to restrict exemplary embodiments to the respectively disclosed forms, but rather that exemplary embodiments are intended to cover all of the functional and/or structural modifications, equivalents and alternatives that are within the scope of the disclosed embodiments. Like reference symbols denote like or similar elements throughout the description of the figures.

It is noted that one element denoted as "connected" or "coupled" to another element can be directly connected or coupled to the other element or that intervening elements can be present. By contrast, if one element is denoted as "directly connected" or "directly coupled" to another element, no intervening elements are present. Other terms used to describe the relationship between elements should be interpreted in a similar way (e.g., "between" vis-à-vis "directly therebetween", "adjacent" vis-à-vis "directly adjacent", etc.).

The terminology used herein serves only to describe specific exemplary embodiments and is not intended to restrict the exemplary embodiments. As used herein, the singular forms "a" and "the" are also intended to include the plural forms, unless clearly indicated otherwise by the context. Furthermore, it should be clarified that the expressions such as, e.g., "comprises", "comprising", "has" and/or "having", as used herein, indicate the presence of stated features, whole numbers, operations, work sequences, elements and/or components, but do not rule out the presence or the addition of one or more features, whole numbers, operations, work sequences, elements, components and/or groups thereof.

Unless defined otherwise, all terms used herein (including technical and scientific terms) have the same meaning that is ascribed to them by a person of average skill in the art in the field to which the exemplary embodiments belong. Further, it should be clarified that expressions, e.g., those defined in generally used dictionaries, should be interpreted as if they had the meaning that is consistent with their meaning in the context of the relevant art, and should not be interpreted in an idealized or excessively formal sense, as long as this is not expressly defined herein.

Increasingly more vehicles provide the option of choosing between multiple sets of settings, for example, for different users. For many use scenarios, it is useful for the settings of a user (what is known as the user profile) to be able to be taken along to other vehicles (e.g., when the same person uses multiple vehicles or when a vehicle is first purchased, rental cars are used, etc.). The most up to date profile of a user could, in exemplary embodiments, ideally already have been applied in the vehicle when it is entered, without further manual operations by the user and, by way of example, irrespective of whether he has already used the vehicle once before.

In conventional systems, it is already possible for a profile to be taken along in some vehicles today by virtue of the settings being exported from one vehicle onto a removable medium and imported again therefrom in the other vehicle. In some vehicles, profiles can also be stored manually in an online service and retrieved therefrom. The designs hitherto for taking along and synchronizing the profiles between vehicles using removable media or online services frequently offer little convenience, since a manual export and import needs to be performed and it is additionally necessary to carry a removable medium.

It is known practice from smartphones for current settings of a service or of an app to be stored on the Internet (for example, in an Internet storage service, also called a Cloud) and to be automatically and continually synchronized between devices in the background.

In practice, the approach is not readily transferrable from a smartphone to the vehicle. Vehicles are often parked at locations at which they have no Internet connection (e.g., underground garages), so that it is not possible for the profiles to be synchronized with the online service at the locations. Additionally, many vehicles involve the Internet connection being established using the customer's telephone. This type of connection is not yet set up in vehicles which the user has not used beforehand, however. Further, synchronization requires particular vehicle systems to be started up that are usually switched off in the idle state and are first activated during the "wakeup process" of the vehicle on unlocking or not until on ignition. These delays can lose a considerable amount of time. Further, in many cases, the user needs to be identified and possibly even additionally authenticated. In this situation, the user can be asked, for example, by the vehicle, to input a user name and password or to select from a list of known users. Both cannot be done until the driver is already sitting in the vehicle and can interact therewith. Alternative approaches such as the use of particular features as indicators for automatic identification, e.g., the key used, mobile devices in range of the vehicle, etc., are frequently not reliable or sometimes also not available until after various vehicle systems have been started up.

In many cases, a lack of Internet connection therefore means that the settings of the vehicle user are not retrieved from the online service. In cases where it is possible, the process can take place with a delay or necessitate complicated work operations in the vehicle (set up use of an Internet connection of the mobile telephone in the vehicle, manual user selection and authentication). The convenience benefit as a result of conventional systems may be restricted, since it is dependent on what user actions are necessary and from when the settings of the user are active—this may apply to ergonomics-relevant settings such as the position of the seats, mirrors, steering column, etc., which are ideally already adjusted when the vehicle is entered.

In future, it can be assumed that vehicles are frequently no longer unlocked using conventional keys, but rather that "digital keys" are used, that is to say certificates or the like on mobile devices (for example, smartphones) that the user carries with him anyway. These certificates can, in some exemplary embodiments, be issued specifically for a combination of hardware of the mobile device and the vehicle, and transmitted to the vehicle wirelessly (e.g., using Bluetooth Low Energy (BTLE) or Near Field Communication (NFC)) for unlocking purposes. The vehicle can, by way of example, check the validity of the certificates and then, if need be, enable vehicle opening and release the engine immobilizer.

Exemplary embodiments can use this radio interface for the digital key to transmit further data that can be used to safely identify the user, for example, when the vehicle is actually unlocked, and are used to transmit to the vehicle the most important information for synchronizing its profile, for example. These data, for example, information about a user profile of FIG. 1-4, can, in some exemplary embodiments, be sent in the same operation as the key certificate (for example, in the key signal) or in a downstream operation, as soon as the certificate has been checked by the vehicle and the vehicle use has been enabled.

FIG. 1 shows an apparatus 10 for an information system 100 of a vehicle 150. The information system 100 can correspond, by way of example, to a central computation unit of the vehicle 150 or can comprise a central computation unit of the vehicle 150. By way of example, the information system can correspond to an onboard information system of the vehicle 150 (also called an onboard unit, OBU) or can comprise the onboard information system, or can correspond to an infotainment system of the vehicle 150, for example, an embedded computer that provides functions for controlling the vehicle functions and/or the vehicle entertainment system. In at least some exemplary embodiments, the vehicle 150 can correspond, by way of example, to a land vehicle, a water craft, an aircraft, a rail vehicle, a road vehicle, a car, an all terrain vehicle, a motor vehicle or a truck.

The apparatus comprises a communication module 12, designed for communication with a mobile device 200. The apparatus further comprises a control module 14, designed for controlling the communication module 12. The communication module 12 may be designed, by way of example, for wireless communication, mobile radio communication and/or for short-range communication. The communication module 12 may be designed, by way of example, to communicate with the mobile device 200 directly. The communication module 12 may be designed, by way of example, to communicate with the mobile device 200 via a short-range radio link. In some exemplary embodiments, the communication module 12 may be designed to use a low-frequency connection to use a key protocol to communicate with the mobile device 200. The communication module 12 can correspond, by way of example, to a Bluetooth communication module, a wireless local access network (WLAN) communication module or an NFC communication module. The communication module 12 may be designed, by way of example, to communicate with the mobile device 200 in encrypted state. The mobile device 200 can correspond, by way of example, to a cell phone, a programmable cell phone, a smartphone, a tablet computer or a mobile key module. In exemplary embodiments, the control module 14, and/or a control module 24 from FIG. 2, can correspond to any controller or processor or a programmable hardware component. By way of example, the control module 14; 24 may also be realized as software that is programmed for a corresponding hardware component. In this respect, the control module 14; 24 may be implemented as programmable hardware with appropriately adapted software. In this situation, it is possible for arbitrary processors, such as digital signal processors (DSPs), to be used. Exemplary embodiments are not restricted to one particular type of processor in this situation. Arbitrary processors or multiple processors are conceivable for implementing the control module 14; 24.

The control module 14 is further designed for obtaining a key signal and information about a user profile from the mobile device 200 via the communication module 12. The key signal can comprise, by way of example, a digital certificate or be based on the latter. The key signal can identify and/or authenticate, by way of example, a key holder, for example, through the use of digital certificates. In some exemplary embodiments, the key signal can correspond to a signal on a low-frequency channel, or the key signal can correspond to data packets of a communication protocol, for example, Bluetooth, BTLE or NFC. In some exemplary embodiments, the key signal can comprise the information about the user profile. In some exemplary embodiments, the control module 14 may be designed to obtain the key signal and the information about the user profile in the same data link, or to obtain the key signal and the information about the user profile within the same data transmission. The mobile device 200 may be designed to provide the key signal and the information about the user profile in the same data link, or to provide the key signal and the information about the user profile within the same data transmission. In at least some exemplary embodiments, the communication module 12 can comprise a communication submodule for secure reception of the key signal from the mobile device 200.

The user profile comprises a plurality of user settings for a plurality of functions of the vehicle 150. The user settings can comprise, by way of example, settings for at least one element from the group comprising seat position, seat attitude, rear view mirror position, exterior mirror position, settings of a multimedia system, navigation settings and display settings of an information system of the vehicle.

The information about the user profile comprises data about at least one subset of the plurality of user settings. In at least some exemplary embodiments, the information about the user profile can comprise, by way of example, configuration data for the subset of the plurality of user settings. By way of example, the information about the user settings may be represented in a structured data format, for example, by a file provided with tags (for example, in eXtensible Markup Language, XML) or in a folder format. Alternatively, the information about the user settings may be based on a binary format, with entries being able to indicate whether further configuration data, for example, as a reference to a variably usable memory area of the binary format, are available.

The control module 14 is designed for controlling a locked state of the vehicle 150 on the basis of the key signal. The control module 14 may be designed, by way of example, to check an authenticity of the key signal, for example, by checking a digital certificate or by decrypting an encrypted data message. The control module 14 may be designed, by way of example, to unlock the vehicle 150 if the key signal is authentic and if the key signal indicates unlocking of the vehicle 150, and to lock the vehicle 150 if the key signal is authentic and indicates locking of the vehicle. In at least some exemplary embodiments, the control module 14 can comprise a key module that can have, by way of example, additional security functions and that is designed to perform control of the locked state, checking of the certificate or decryption of the encrypted data message. In some exemplary embodiments, the control module 14 can comprise a vehicle control system for controlling vehicle locking functions.

The control module 14 is further designed for controlling at least one subset of the plurality of functions of the vehicle 150 on the basis of the information about the user profile. The control module 14 may be designed, by way of example, to adapt at least the subset of the functions in accordance with the user settings on the basis of the user profile and/or the information about the user profile or, if they match currently applied settings, to adopt the subset of the functions. The control module 14 may be designed, by way of example, to forward the user settings for controlling further modules, for example, multimedia modules or seat adjustment modules. In some exemplary embodiments, the control module 14 may be designed to convert the user settings for use in the vehicle 150 and to perform control on the basis of the converted settings.

In at least some exemplary embodiments, the control module 14 may be designed to store the user profile in a first version. The information about the user profile can comprise, by way of example, information about an identification of the user, for example, a user identifier or a login name and a password. The control module 14 may be designed, by way of example, to obtain from a server and store the user profile on the basis of the information about the identification of the user. Alternatively or additionally, the control module 14 may be designed to obtain the first version of the user profile from the server, for example, on initiation by the mobile device 200 or on the basis of a user assignment to the vehicle, for example, by the server. The control module 14 may be designed, by way of example, to retrieve from the server and store the user profile or a subset of the user profile. In some exemplary embodiments, the control module 14 may further be designed to provide the stored version for the server.

In some exemplary embodiments, the control module 14 may be designed to store one or more user profiles. The information about the user profile can comprise, by way of example, information about an identification of the user. The control module 14 may be designed, by way of example, to obtain the one or more user profiles from a server. The one or more user profiles can comprise, by way of example, user settings of a group of users or user settings of probable users of the vehicle 150. The control module 14 may be designed to select a user profile from the one or more user profiles on the basis of the information about the identification of the user and to control at least one subset of the plurality of functions of the vehicle 150 on the basis of the selected user profile. The selected user profile can subsequently correspond to the stored or the first user profile. In some exemplary embodiments, the control module 14 may be designed to take the key signal or to take a source of the key signal as a basis for selecting the user profile.

The information about the user profile can comprise information about a second version of the user profile. The second version of the user profile may be at least in part more up to date than the first version of the user profile. The control module 14 may be designed to update the stored version of the user profile on the basis of the information about the user profile. The control module 14 may be designed, by way of example, to update only a subset of the user settings of the stored version that are less up to date than user settings that the information about the user profile comprises.

In an exemplary implementation, the stored version of the user profile can comprise information about a first version counter and the information about the user profile can comprise information about a second version counter. The control module 14 may be designed, by way of example, to update the stored version on the basis of the information about the first version counter and on the basis of the information about the second version counter. A version counter, for example, the first version counter or the second version counter, can correspond to a binary, decimal, hexadecimal, alphanumeric and/or mixed counter, and can further comprise, by way of example, information about a change date and/or information about a change location or originator. A version counter, for example, the first version counter or the second version counter, can indicate, by way of example, a version of the user profile, or a version of a user setting for a function from the plurality of functions. A version counter can, in this situation, allow a distinction regarding which version is at least in part more up to date. The control module 14 may be designed, by way of example, to compare the first version counter with the second version counter to decide whether an update of the user profile or an update of a subset of the user profile needs to be performed. In at least some exemplary embodiments, the control module 14 is further designed likewise to update the information about the first version counter on the basis of the update, for example, on the basis of the information about the second version counter.

In some exemplary embodiments, the information about the first version counter can comprise information about version counters for the plurality of functions. The information about the second version counter can comprise information about version counters for the subset of the plurality of functions. The control module 14 may be designed to update the stored version of the user profile on the basis of the information about the version counters for the plurality of functions and on the basis of the information about the version counters for the subset of the plurality of functions. The control module 14 may be designed, in an exemplary implementation, to check for each or a subset of the plurality of functions whether the respective version counter of the information about the subset of the plurality of functions indicates a more up to date version of the user setting than the stored version counter of the information about the version counters for the plurality of functions. In at least some exemplary embodiments, the control module 14 is designed likewise to update the stored version counter of the information about the version counters for the plurality of functions on the basis of the update of the user profile.

In at least some exemplary embodiments, the control module 14 may be designed to provide the information about the first version counter for the mobile device 200. The information about the user profile may be based on the information about the first version counter and on the information about the second version counter. The control module 14 may be designed, by way of example, to provide the information about the first version counter for the mobile device 200 directly, for example, during a locking process on the basis of the key signal, or the control module 14 may be designed to provide the information about the first version counter for a server, wherein the mobile device 200 is designed to obtain the information about the first version counter from the server. The server may be designed, by way of example, to manage the user profile and to obtain the information about the first version counter of the vehicle 150 from the control module 14 and to provide it for the mobile device 200.

In at least some exemplary embodiments, the stored version of the user profile can comprise a first piece of information about the last change time of the stored version of the user profile. The information about the user profile can comprise a second piece of information about a last change time of the second version of the user profile. A piece of information about a last change time, for example, the first information about the last change time of the stored version and/or the second information about the last change time of the second version, can comprise, by way of example, information about one or more time(s) at which the user profile or a subset of the user profile has been altered, and may be, by way of example, exact to the day, exact to the hour, exact to the minute, exact to the second or exact to the millisecond and/or comprise information about a time zone of the one or more times. The control module 14 may be designed to update the stored version of the user profile on the basis of the first information about the last change time of the stored version of the user profile and on the basis of the second information about the last change time of the second version of the user profile. The control module 14 may be designed, in an exemplary implementation, to check for each or a subset of the plurality of functions whether the respective change time of the second information about the last change time of the second version indicates a more up to date version of the user profile or of the user setting than the first information about the last change time of the first/stored version. In at least some exemplary embodiments, the control module 14 is designed likewise to update the last change time of the first information about the last change time of the first version on the basis of the update of the user profile.

In some exemplary embodiments, the first information about the last change time of the first version can comprise information about change times for the plurality of functions. The second information about the last change time of the second version can comprise information about change times for the subset of the plurality of functions. The control module 14 may be designed to update the stored version of the user profile on the basis of the information about the change times for the plurality of functions and on the basis of the information about the change times for the subset of the plurality of functions. The control module 14 may be designed, in an exemplary implementation, to check for each or a subset of the plurality of functions whether the respective last change time of the information about change times for the subset of the plurality of functions indicates a more up to date version of the user setting than the stored change time of the information about change times for the plurality of functions. In at least some exemplary embodiments, the control module 14 is designed likewise to update the stored last change time of the information about change times for the plurality of functions on the basis of the update of the user profile.

In at least some exemplary embodiments, the control module 14 may be designed to provide the first information about the last change time of the first version for the mobile device 200. The information about the user profile may be based on the first information about the last change time of the first version and on the second information about the last change time of the second version. The control module 14 may be designed, by way of example, to provide the first information about the last change time of the first version for the mobile device 200 directly, for example, during a locking process on the basis of the key signal, or the control module 14 may be designed to provide the first information about the last change time of the first version for a server, wherein the mobile device 200 is designed to obtain the first information about the last change time of the first version from the server. The server may be designed, by way of example, to manage the user profile and to obtain the first information about the last change time of the first version of the vehicle 150 from the control module 14 and provide it for the mobile device 200.

Figure 2:
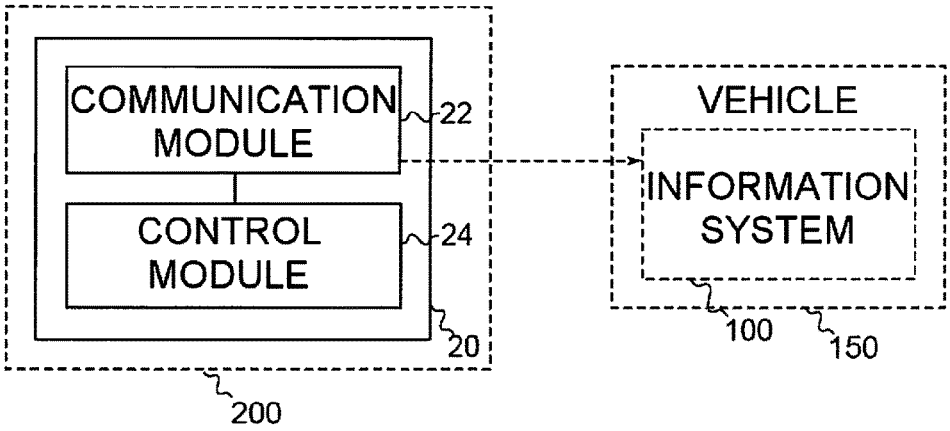
FIG. 2 illustrates a block diagram of an exemplary embodiment of an apparatus for a mobile device.

FIG. 2 illustrates a block diagram of an exemplary embodiment of an apparatus 20 for a mobile device 200. The apparatus comprises a communication module 22, designed for communication with an information system 100 of a vehicle 150. The communication module 22 may be designed, by way of example, for wireless communication, mobile radio communication and/or for short-range communication. The communication module 22 may be designed, by way of example, to communicate with the information system 100 directly. The communication module 22 may be designed, by way of example, to communicate with the information system 100 via a short-range radio link. In some exemplary embodiments, the communication module 22 may be designed to use a low-frequency connection to use a key protocol to communicate with the information system 100. The communication module 22 can correspond, by way of example, to a Bluetooth communication module, a wireless local access network (WLAN) communication module or an NFC communication module. The communication module 22 may be designed, by way of example, to communicate with the information system 100 in encrypted state.

The apparatus 20 further comprises the control module 24, designed for controlling the communication module 22.

The control module 24 is further designed for providing a key signal for controlling a locked state of the vehicle 150 and information about a user profile for controlling at least one subset of a plurality of functions of the vehicle 150 for the information system 100 via the communication module 22. The user profile comprises a plurality of user settings for the plurality of functions of the vehicle 150, and the information about the user profile comprises data about at least one subset of the plurality of user settings.

In some exemplary embodiments, the control module 24 may be designed to obtain the information about the user profile from a server. Alternatively, the control module 24 may be designed, by way of example, to obtain the user profile from the server and to determine the information about the user profile on the basis of the user profile, for example, to comprise only information about user settings for the subset of the functions. In some exemplary embodiments, the control module 24 may be designed to create the user profile on the basis of user outputs and to provide the information about the user profile on the basis of the user profile. In some exemplary embodiments, the control module 24 may be designed to obtain the user profile or the information about the user profile from a further vehicle.

In some exemplary embodiments, the information system can comprise a first version of the user profile. The control module 24 may be designed to determine the information about the user profile on the basis of a second version of the user profile. The second version of the user profile may be at least in part more up to date than the first version of the user profile.

The first version of the user profile can comprise information about a first version counter and the second version of the user profile can comprise information about a second version counter. The control module 24 may further be designed to obtain the information about the first version counter from the information system 100. The control module 24 may be designed, by way of example, to obtain the information about the first version counter directly from the information system 100, for example, during a locking process on the basis of the key signal, or the control module 24 may be designed to obtain the information about the first version counter from a server, wherein the information system 200 is designed to provide the information about the first version counter for the server. The control module 24 may further be designed to provide the information about the user profile on the basis of the information about the first version counter and on the basis of the information about the second version counter. The control module 24 may be designed, by way of example, to determine the information about the user profile on the basis of a subset of the functions, for which user profile a comparison of the information about the first version counter and the information about the second version counter indicates that the user settings that the second version comprises for the functions is more up to date than the user settings that the first version comprises.

Alternatively or additionally, the first version of the user profile can comprise a first piece of information about a last change time of the first version of the user profile. The second version can comprise a second piece of information about a last change time of the second version of the user profile. The control module 24 may be designed to provide the information about the user profile on the basis of the first information about the last change time of the first version and on the basis of the second information about the last change time of the second version. The control module 24 may be designed, by way of example, to determine the information about the user profile on the basis of a subset of the functions, for which user profile a comparison of the first information about the last change time of the first version and of the second information about the last change time of the second version, so that the user settings that the second version comprises for the functions is more up to date than the user settings that the first version comprises.

In an exemplary embodiments by way of example, a smartphone, for example, the cell phone 200 and the control module 24 thereof for the apparatus 20, stores a local copy of the user profile of the user, portions thereof or metadata therefor (depending on the exemplary embodiment). To obtain these data, the smartphone can use its Internet connection to be in contact with a server or online service that is used for synchronizing the user profiles. The data pertaining to the user profile on the smartphone can be updated in this situation in some exemplary embodiments, for example, on the basis of at least one of the following options:

- When changes to the profile have been made and transmitted to the online service, registered smartphones, for example, the control module 24 of the mobile device 200, can be notified by the online service (push notification). The notification can comprise, by way of example, changes pertaining to the profile, or the smartphone (the control module 24) may be designed to subsequently retrieve the changes.
- The smartphone could, for example, also at particular times, repeatedly ask the online service for synchronizing the user profiles about alterations and retrieve the alterations if need be, for example, on the basis of the second information about the last change time or on the basis of the information about the second version counter. The control module 24 may be designed to retrieve the changes when data are "cheap" (that is to say, by way of example, in a WLAN), when approaching the vehicle (since it is then assumed that the vehicle will soon be driven), immediately only at the beginning of the unlocking process with the digital key or cyclically at predefined intervals.

For the purpose of transmitting the key signal or for the key signal, the control module 24 may be designed to set up a secure, wireless data link to the information system 100. The control module 24 may be designed to use the same data link to transmit the information about the user profile, for example, so as thereby to synchronize the current profile from the online service with the vehicle more quickly than would be possible in conventional systems.

The control module 24 may be designed, by way of example, to transmit the user profile stored on the mobile device 200 to the information system 100 at least in part. By way of example, the control module 24 may be designed to transmit user settings for a subset of the plurality of functions that are needed early. In some exemplary embodiments, not all parts of the profile are needed at the beginning of a journey. Although this is frequently the case for ergonomics-relevant settings, settings such as detailed settings pertaining to navigation preferences are frequently less time-critical. Alternatively or additionally, the control module 24 may be designed to transmit only changes since the last synchronization of the profile (of the first version). If the online service knows which vehicle is unlocked and which version of the profile of the user is already available there, then the control module 24 may be designed to provide only the changes to the user profile for the information system 100. The volume of data to be transmitted can, in some exemplary embodiments, thereby be reduced in comparison with a transmission of the complete user profile.

In some exemplary embodiments, the control module 24 may be designed to obtain a time of the last change or of a version counter from the online service or the vehicle 150 and to provide the information about the user profile having only the changes. Alternatively or additionally, the control module 14 may be designed to obtain the information about the version counter of the second version from the control module 14 and to compare the version counter with the one (first version counter) that is available to it from the last synchronization with the online service. The control module 14 may be designed to establish whether there have been, since the last synchronization, changes to the profile that have not been available locally in the information system to date. If this is not the case, then the copy of the user profile that is already available locally can continue to be used. If the version is not up to date, then the control module 14 may be designed to signal to the user that updated data can still be retrieved and could put the vehicle into a special mode of operation, in which a servicing display is displayed and the seats and other ergonomics settings are moved to safe standard or maximum positions, until its Internet connection is established. In this case, very few data would be able to be transmitted between smartphone and vehicle.

In some exemplary embodiments, the control module 24 may be designed to provide information about an identification of the user comprised in the information about the user profile for the information system 100. This information about the identification of the user may be, by way of example, an identifier of the user that is also used to authenticate the user to the online service (e.g. the user name for an online service of a vehicle manufacturer) and may be independent of the unlocking mobile device. Alternatively, the information about the identification may be based on a specific identifier for the mobile device 200. Since these devices are frequently personal, the control module 14 may be designed to take this as a basis for ascertaining the user by again using the manually selected user for a previous user of the vehicle with this device identifier. This can work, in exemplary embodiments, for vehicles that the user has already used once before, for example, until the user changes mobile device.

More details of the apparatus 20 (e.g. key signal, information about a user profile, user profile, information system 100, vehicle 150, mobile device 200, information about last change time, version counter, plurality of functions, subset of the plurality of functions, first version of the user profile, second version of the user profile) are cited in conjunction with the design or examples that have been described previously (e.g. FIG. 1). The apparatus 20 can comprise one or more additionally optional features that correspond to one or more embodiments of the proposed design or of the described examples, as have been described previously or subsequently.

Figure 3:
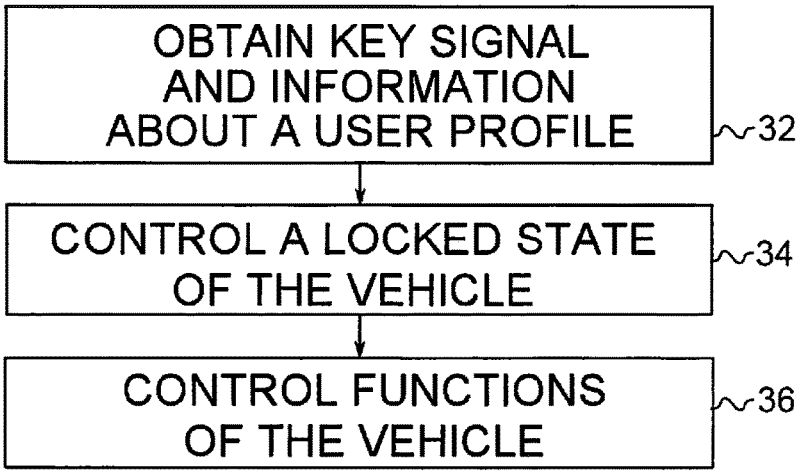
FIG. 3 illustrates a flowchart for an exemplary embodiment of a method for an information system of a vehicle.

FIG. 3 illustrates a flowchart for an exemplary embodiment of a method for an information system 100 of a vehicle 150. The method comprises obtaining 32 a key signal and information about a user profile from a mobile device 200. The user profile comprises a plurality of user settings for a plurality of functions of the vehicle 150. The information about the user profile comprises data about at least one subset of the plurality of user settings. The method further comprises controlling 34 a locked state of the vehicle 150 on the basis of the key signal. The method further comprises controlling 36 at least one subset of the plurality of functions of the vehicle 150 on the basis of the information about the user profile.

Figure 4:
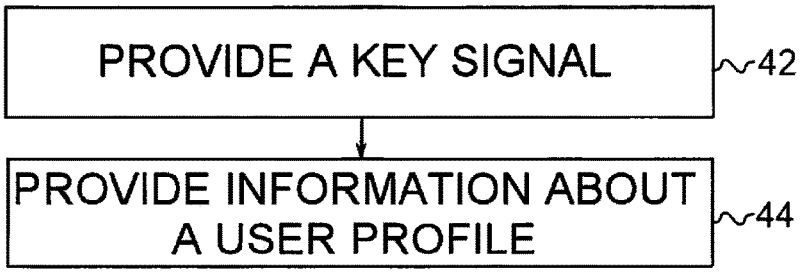
FIG. 4 illustrates a flowchart for an exemplary embodiment of a method for a mobile device.

FIG. 4 illustrates a flowchart for an exemplary embodiment of a method for a mobile device 200. The method comprises providing 42 a key signal for controlling a locked state of a vehicle 150. The method further comprises providing 44 information about a user profile for controlling at least one subset of a plurality of functions of the vehicle 150 for an information system 100 of the vehicle. The user profile comprises a plurality of user settings for the plurality of functions of the vehicle 150. The information about the user profile comprises data about at least one subset of the plurality of user settings.

A further exemplary embodiment is a computer program for performing at least one of the methods described above when the computer program runs on a computer, a processor or a programmable hardware component. A further exemplary embodiments is also a digital storage medium that is machine- or computer-readable and that has electronically readable control signals that can interact with a programmable hardware component such that one of the methods described above is carried out.

Exemplary embodiments can allow user settings to be transmitted to vehicles quickly, even without the vehicles needing an Internet connection at that moment. As a result, the settings of the user may already be available when the vehicle is entered, even in vehicles that the user has not driven beforehand to date (e.g. rental car). The user can be provided with a convenience benefit.

The features disclosed in the description above, the claims below and the appended figures may be of importance, and can be implemented, both individually and in any combination for the realization of an exemplary embodiment in its various configurations.

Although some embodiments have been described in connection with an apparatus, it goes without saying that these embodiments also represent a description of the corresponding method, so that a block or a component of an apparatus should also be understood as a corresponding method operation or as a feature of a method operation. Analogously to this, embodiments described in connection with or as a method operation also represent a description of a corresponding block or detail or feature of a corresponding apparatus.

Depending on particular implementation requirements, exemplary embodiments can be implemented in hardware or in software. The implementation can be performed using a digital storage medium, for example, a floppy disk, a DVD, a Blu-Ray disk, a CD, a ROM, a PROM, an EPROM, an EEPROM or a FLASH memory, a hard disk or another magnetic or optical memory that stores electronically readable control signals that can interact or do interact with a programmable hardware component such that the respective method is performed.

A programmable hardware component may be formed by a processor, a computer processor (CPU=Central Processing Unit), a graphics processor (GPU=Graphics Processing Unit), a computer, a computer system, an application-specific integrated circuit (ASIC), an integrated circuit (IC), a system on chip (SOC), a programmable logic element or a field programmable gate array (FPGA) with a microprocessor.

The digital storage medium may therefore be machine- or computer-readable. Some exemplary embodiments thus comprise a data medium that has electronically readable control signals that are capable of interacting with a programmable computer system or a programmable hardware component such that one of the methods described herein is performed. One exemplary embodiment is therefore a data medium (or a digital storage medium or a computer-readable medium) on which the program for performing one of the methods described herein is recorded.

Generally, exemplary embodiments may be implemented as a program, firmware, computer program or computer program product having a program code or as data, wherein the program code or the data is or are operative to the effect of performing one of the methods when the program runs on a processor or a programmable hardware component. The program code or the data may, by way of example, also be stored on a machine-readable medium or data medium. The program code or the data can be present inter alia as source code, machine code or byte code and as other intermediate code.

A further exemplary embodiment is further a data stream, a signal train or a sequence of signals that represents or represent the program for performing one of the methods described herein. The data stream, the signal train or the sequence of signals may be configured, by way of example, to the effect of being transferred via a data communication link, for example, via the Internet or another network. Exemplary embodiments are thus also data-representing signal trains that are suitable for sending via a network or a data communication link, wherein the data represent the program.

A program according to one exemplary embodiment can implement one of the methods while it is being performed, for example, by reading these memory locations or writing a datum or multiple data thereto, as a result of which, if need be, switching processes or other processes are brought about in transistor structures, in amplifier structures or in other electrical components, optical components, magnetic components or components operating according to another functional principle. Accordingly, by virtue of a memory location being read, it is possible for data, values, sensor values or other information to be captured, determined or measured by a program. A program can therefore capture, determine or measure variables, values, measured variables and other information by reading one or more of the memory locations, and can bring about, prompt or perform an action, and actuate other devices, machines and components, by writing to one or more memory locations.

The exemplary embodiments described above are merely an illustration of the principles of the disclosed embodiments. It goes without saying that modifications and variations of the arrangements and details described herein will become apparent to other persons skilled in the art. Therefore, the intention is for the disclosed embodiments to be restricted only by the scope of protection of the patent claims below, and not by the specific details that have been presented herein on the basis of the description and the explanation of the exemplary embodiments.

LIST OF REFERENCE SYMBOLS

10 Apparatus for an information system of a vehicle
12 Communication module
14 Control module
20 Apparatus for a mobile device
22 Communication module
24 Control module
32 Obtain
34 Control
36 Control
42 Provide
44 Provide
100 Information system
150 Vehicle
200 Mobile device

The invention claimed is:

1. An apparatus for an information system of a vehicle, the apparatus comprising:

a vehicle communication module for communication with a mobile device; and a vehicle control module, wherein the vehicle control module:

controls the vehicle communication module, obtains a key signal and information about a first user profile from the mobile device via the vehicle communication module, wherein the first user profile comprises a plurality of user settings for a plurality of functions of the vehicle and a first version counter for the plurality of user settings for the plurality of functions, identifies at least one subset of the plurality of user settings for the plurality of functions based on whether the plurality of user settings for the plurality of functions match the currently applied settings in the vehicle, stores the first user profile in a first version, controls a locked state of the vehicle based on the key signal, and controls the at least one subset of the plurality of user settings for the plurality of functions of the vehicle that is identified as not currently applied in the vehicle, wherein to obtain the key signal and information about the first user profile from the mobile device comprises to obtain a first part of the at least one subset of the plurality of user settings for the plurality of functions based on a need to implement the first part of the at least one subset of the plurality of user settings for the plurality of functions earlier than a second part of the at least one subset of the plurality of user settings for the plurality of functions.

2. The apparatus of claim 1, wherein the key signal comprises the information about the user profile.

3. The apparatus of claim 1, wherein the vehicle control module receives information about a second user profile from the mobile device, wherein the second user profile comprises the plurality of user settings for the plurality of functions of the vehicle and a second version counter for the plurality of user settings for the plurality of functions, and wherein the vehicle control module updates the stored first version of the first user profile based on the information about the second user profile.

4. The apparatus of claim 3, wherein the vehicle control module updates the stored first version based on the information about the first version counter for the plurality of user settings for the plurality of functions and based on the information about the second version counter for the plurality of user settings for the plurality of functions.

5. The apparatus of claim 4, wherein the information about the first version counter comprises information about one or more first version counters for the plurality of user settings for the plurality of functions, and wherein the information about the second version counter comprises information about one or more second version counters for the plurality of user settings for the plurality functions, and wherein the vehicle control module identifies the at least one subset of the plurality of user settings for the plurality of functions based on whether the one or more first version counters match the one or more second version counters, and wherein the vehicle control module updates the stored first version of the first user profile based on the at least one subset of the plurality of user settings for the plurality of functions that is identified based on different version counters between the one or more first version counters and the one or more second version counters for the plurality of user settings for the plurality of functions, and wherein the one or more second version counters are different from the one or more first version counters in response to an update or change to one or more user settings of the plurality of user settings for the plurality of functions associated with the one or more second version counters.

6. The apparatus of claim 3, wherein the stored first version of the first user profile comprises a first piece of information about a last change time of the stored first version of the first user profile, and wherein the information about the second user profile comprises a second piece of information about a last change time of the second version of the second user profile, wherein the vehicle control module updates the stored first version of the first user profile based on the first information about the last change time of the stored first version of the first user profile and based on the second information about the last change time of the second version of the second user profile.

7. The apparatus of claim 6, wherein the first information about the last change time of the first version comprises information about one or more first change times for the plurality of user settings for the plurality of functions, and wherein the second information about the last change time of the second version comprises information about one or more second change times for the plurality of user settings for the plurality of functions, and wherein the vehicle control module identifies the at least one subset of the plurality of user settings for the plurality of functions based on whether the one or more first change times match the one or more second change times, and wherein the vehicle control module updates the stored first version of the first user profile based on the at least one subset of the plurality of user settings for the plurality of functions that is identified based on different last change times between the one or more first change times for the plurality of user settings for the plurality of functions and the one or more second change times for the plurality of user settings for the plurality of functions, and wherein the one or more second change times are different from the one or more first change times in response to a change to one or more user settings of the plurality of user settings for the plurality of functions associated with the one or more second change times.

8. The apparatus of claim 1, wherein the information about the first user profile comprises information about an identification of the user, and wherein the vehicle control module obtains the first user profile based on the information about the identification of the user from a server.

9. The apparatus of claim 1, wherein the control module stores one or more user profiles, wherein the information about the first user profile comprises information about an identification of the user, and wherein the control module selects a first user profile from the one or more user profiles based on the information about the identification of the user and to control the at least one subset of the plurality of functions of the vehicle based on the selected user profile.

10. The apparatus of claim 1, wherein the vehicle communication module communicates with the mobile device directly, and/or wherein the vehicle communication module communicates with the mobile device via a short-range radio link.

11. An apparatus for a mobile device, the apparatus comprising:

a mobile communication module for communication with an information system of a vehicle; and a mobile control module, wherein the mobile control module:

controls the mobile communication module, and provides a key signal for controlling a locked state of the vehicle and information about a first user profile for controlling at least one subset of a plurality of user settings for a plurality of functions of the vehicle for the information system via the mobile communication module, wherein the first user profile comprises information about the plurality of user settings for the plurality of functions of the vehicle and a first version counter for the plurality of user settings for the plurality of functions, and wherein the at least one subset of the plurality of user settings for the plurality of functions is identified based on whether the plurality of user settings for the plurality of functions match the currently applied settings in the vehicle, and wherein, to provide the key signal and information about the first user profile comprises to provide a first part of the at least one subset of a plurality of user settings for a plurality of functions based on a need to implement the first part of the at least one subset of a plurality of user settings for a plurality of functions earlier than a second part of the at least one subset of a plurality of user settings for a plurality of functions.

12. The apparatus of claim 11, wherein the information system comprises a first version for the first user profile, and wherein the mobile control module receives a second user profile from a user of the mobile device, wherein the second user profile comprises the plurality of user settings for the plurality of functions of the vehicle and a second version counter for the plurality of user settings for the plurality of functions, wherein the mobile control module obtains the information about the first version counter from the information system, and wherein the mobile control module provides the information about the second user profile based on the information about the first version counter and based on the information about the second version counter, and/or wherein the first user profile comprises a first piece of information about a last change time of the first user profile, and wherein the second user profile comprises a second piece of information about a last change time of the second user profile, and wherein the mobile control module provides the information about the second user profile based on the first information about the last change time of the first user profile and based on the second information about the last change time of the second user profile.

13. A method for an information system of a vehicle, the method comprising:

obtaining, by a vehicle communication module of the vehicle, a key signal and information about a first user profile from a mobile device, wherein the first user profile comprises information about a plurality of user settings for a plurality of functions of the vehicle and a first version counter for the plurality of user settings for the plurality of functions;

identifying, by a vehicle control module of the vehicle, at least one subset of the plurality of user settings for the plurality of functions based on whether the plurality of user settings for the plurality of functions match the currently applied settings in the vehicle;

storing, by the vehicle control module, the first user profile in a first version;

controlling, by the vehicle control module, a locked state of the vehicle based on the key signal; and controlling, by the vehicle control module, the at least one subset of the plurality of user settings for the plurality of functions of the vehicle that is identified as not currently applied in the vehicle, wherein obtaining the key signal and information about the first user profile from the mobile device comprises obtaining a first part of the at least one subset of the plurality of user settings for the plurality of functions based on a need to implement the first part of the at least one subset of the plurality of user settings for the plurality of functions earlier than a second part of the at least one subset of the plurality of user settings for the plurality of functions.

14. A method for a mobile device, the method comprising:

providing, by a mobile communication module, a key signal for controlling a locked state of a vehicle; and providing, by the mobile communication module, information about a first user profile for controlling at least one subset of a plurality of user settings for a plurality of functions of the vehicle for an information system of the vehicle, wherein the first user profile comprises information about the plurality of user settings for the plurality of functions of the vehicle and a first version counter for the plurality of user settings for the plurality of functions, and wherein the at least one subset of the plurality of user settings for the plurality of functions match the currently applied settings in the vehicle, and wherein providing the key signal and information about the first user profile comprises providing a first part of the at least one subset of a plurality of user settings for a plurality of functions based on a need to implement the first part of the at least one subset of a plurality of user settings for a plurality of functions earlier than a second part of the at least one subset of a plurality of user settings for a plurality of functions.

15. A non-transitory readable medium installed in a vehicle and including a program having a program code, stored on the non-transitory readable medium, wherein the program is for performing a method for an information system of the vehicle when the program code is executed on a computer, a processor, a control module or a programmable hardware component in the vehicle, the method comprising:

obtaining a key signal and information about a first user profile from a mobile device, wherein the first user profile comprises information about a plurality of user settings for a plurality of functions of the vehicle and a first version counter for the plurality of user settings for the plurality of functions;

identifying at least one subset of the plurality of user settings for the plurality of functions based on whether the plurality of user settings for the plurality of functions match the currently applied settings in the vehicle;

storing the first user profile in a first version;

controlling a locked state of the vehicle based on the key signal; and controlling at least one subset of the plurality of user settings for the plurality of functions of the vehicle that is identified as not currently applied in the vehicle, wherein the key signal and information about the first user profile comprises providing a first part of the at least one subset of a plurality of user settings for a plurality of functions based on a need to implement the first part of the at least one subset of a plurality of user settings for a plurality of functions earlier than a second part of the at least one subset of a plurality of user settings for a plurality of functions.

16. A non-transitory readable medium installed in a mobile device and including a program having a program code, stored on the non-transitory readable medium a of the mobile device, wherein the program is for performing a method for the mobile device when the program code is executed on a computer, a processor, a control module or a programmable hardware component, the method comprising:

providing a key signal for controlling a locked state of a vehicle; and providing information about a first user profile for controlling at least one subset of a plurality of user settings for a plurality of functions of the vehicle for an information system of the vehicle, wherein the first user profile comprises information about the plurality of user settings for the plurality of functions of the vehicle and a first version counter for the plurality of user settings for the plurality of functions, and wherein the at least one subset of the plurality of user settings for the plurality of functions match the currently applied settings in the vehicle, and wherein providing the key signal and information about the first user profile comprises providing a first part of the at least one subset of a plurality of user settings for a plurality of functions based on a need to implement the first part of the at least one subset of a plurality of user settings for a plurality of functions earlier than a second part of the at least one subset of a plurality of user settings for a plurality of functions.

* * * * *